US008132904B2

(12) United States Patent
Anderson, Jr. et al.

(10) Patent No.: US 8,132,904 B2
(45) Date of Patent: Mar. 13, 2012

(54) FILTER/WICKING STRUCTURE FOR MICRO-FLUID EJECTION HEAD

(75) Inventors: James Daniel Anderson, Jr., Harrodsburg, KY (US); Trevor Daniel Gray, Midway, KY (US); David Emerson Greer, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 1324 days.

(21) Appl. No.: 11/314,273

(22) Filed: Dec. 21, 2005

(65) Prior Publication Data

US 2011/0096121 A1 Apr. 28, 2011

(51) Int. Cl.
*B41J 2/175* (2006.01)

(52) U.S. Cl. ..... 347/93; 347/86

(58) Field of Classification Search ..... 347/85–86, 347/93

See application file for complete search history.

(56) References Cited

U.S. PATENT DOCUMENTS

| | | | | |
|---|---|---|---|---|
| 5,432,100 | A | 7/1995 | Smith et al. | |
| 5,657,065 | A | 8/1997 | Lin | |
| 5,949,458 | A | 9/1999 | Studholme | |
| 6,086,195 | A | 7/2000 | Bohorquez et al. | |
| 6,250,746 | B1 | 6/2001 | Ito et al. | |
| 6,766,817 | B2 | 7/2004 | da Silva | |
| 6,783,219 | B2 | 8/2004 | Lui et al. | |
| 6,832,828 | B2 | 12/2004 | Silverbrook | |
| 6,834,946 | B2 | 12/2004 | McKinnell et al. | |
| 7,285,255 | B2 | 10/2007 | Kadlec et al. | |
| 7,448,742 | B2 * | 11/2008 | Shaw | 347/93 |

FOREIGN PATENT DOCUMENTS

GB 1 300 202 12/1972

* cited by examiner

*Primary Examiner* — Lamson Nguyen

(57) ABSTRACT

A micro-fluid ejection head structure and a method for assembling a micro-fluid ejection head structure. The micro-fluid ejection head structure includes a molded, non-fibrous wicking and filtration structure. The wicking and filtration structure is fixedly attached to a filtered fluid reservoir of the micro-fluid ejection head structure for flow of filtered fluid to a micro-fluid ejection head attached to the head structure.

19 Claims, 7 Drawing Sheets

FILTER/WICKING STRUCTURE FOR MICRO-FLUID EJECTION HEAD

FIELD

The disclosure relates to micro-fluid ejection heads, and in particular to improved filtration and fluid delivery devices for micro-fluid ejection heads.

BACKGROUND AND SUMMARY

Micro-fluid ejection heads are useful for ejecting a variety of fluids including inks, cooling fluids, pharmaceuticals, lubricants and the like. A widely used micro-fluid ejection head is in an ink jet printer. Ink jet printers continue to be improved as the technology for making the micro-fluid ejection heads continues to advance. New techniques are constantly being developed to provide low cost, highly reliable printers which approach the speed and quality of laser printers. An added benefit of ink jet printers is that color images can be produced at a fraction of the cost of laser printers with as good or better quality than laser printers. All of the foregoing benefits exhibited by ink jet printers have also increased the competitiveness of suppliers to provide comparable printers and supplies for such printers in a more cost efficient manner than their competitors.

Micro-fluid ejection devices may be provided with permanent, semi-permanent, or replaceable ejection heads. Since the ejection heads require unique and relatively costly manufacturing techniques, some ejection devices are provided with permanent or semi-permanent ejection heads. In order to protect the ejection heads for long term use filtration structures are used between a fluid supply cartridge and the ejection heads to remove particles which may clog microscopic fluid flow paths in the ejection heads. Conventional filtration structures include multiple components that must be precisely assembled to a filtered fluid reservoir adjacent to an ejection head. Because of the multiple components required for the filtration structures, assembly of the structures is time consuming and requires relatively wide manufacturing tolerances.

In view of the foregoing, exemplary embodiments of the disclosure provide a micro-fluid ejection head structure and a method for assembling a micro-fluid ejection head structure. The micro-fluid ejection head structure includes a molded, non-fibrous wicking and filtration structure. The wicking and filtration structure is fixedly attached to a filtered fluid reservoir of the micro-fluid ejection head structure for flow of filtered fluid to a micro-fluid ejection head attached to the head structure.

Another exemplary embodiment of the disclosure provides a method for assembling a micro-fluid ejection head structure for a fluid supply cartridge. The method includes providing a molded, non-fibrous wicking and filtration structure. The wicking and filtration structure is fixedly attached to a filtered fluid reservoir of the micro-fluid ejection head structure for flow of filtered fluid from a supply cartridge to a micro-fluid ejection head attached to the head structure.

Yet another exemplary embodiment of the disclosure provides a fluid supply cartridge carrier. The fluid supply cartridge carrier includes a permanent or semi-permanent micro-fluid ejection head structure. The ejection head structure contains a micro-fluid ejection head, a filtered fluid reservoir in fluid flow communication with the micro-fluid ejection head, and a wicking and filtration structure fixedly attached to the filtered fluid reservoir for flow of filtered fluid to the filtered fluid reservoir. The wicking and filtration structure includes a molded, non-fibrous wicking and filtration element.

An advantage of the exemplary embodiments described herein is that a unitary component may be used in place of multiple components to provide comparable or better protection of micro-fluid ejection heads. Use of a unitary component eliminates several steps required for assembling a wicking and filtration structure to a fluid reservoir of a micro-fluid ejection head structure. The unitary component also reduces the tolerance stack up compared to a multi-part component tolerance stack up since the unitary component is specified to a single tolerance.

BRIEF DESCRIPTION OF THE DRAWINGS

Further features and advantages of the disclosed embodiments may become apparent by reference to the detailed description when considered in conjunction with the figures, which are not to scale, wherein like reference numbers indicate like elements through the several views, and wherein.

DETAILED DESCRIPTION OF THE PREFERRED EMBODIMENTS

Figure 1:
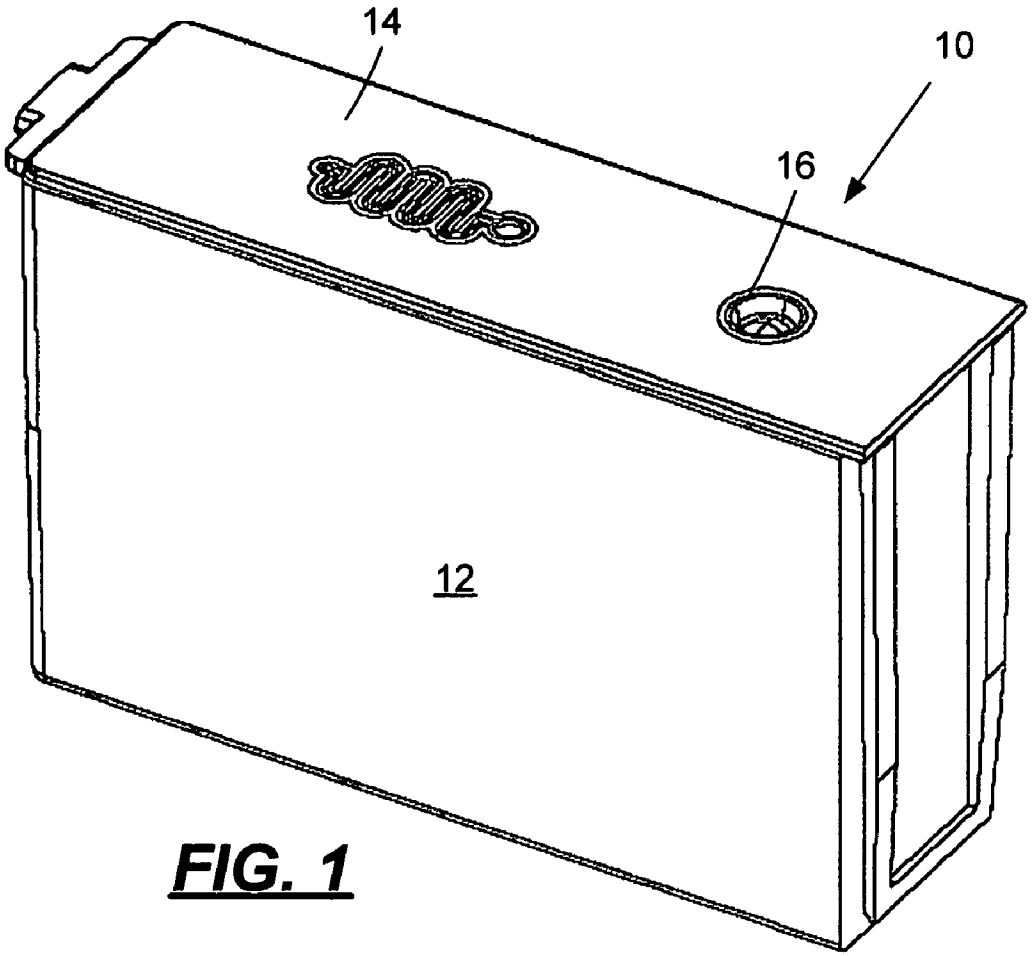
FIG. 1 is a top perspective view, not to scale, of a fluid supply cartridge and cover therefore.
Figure 2:
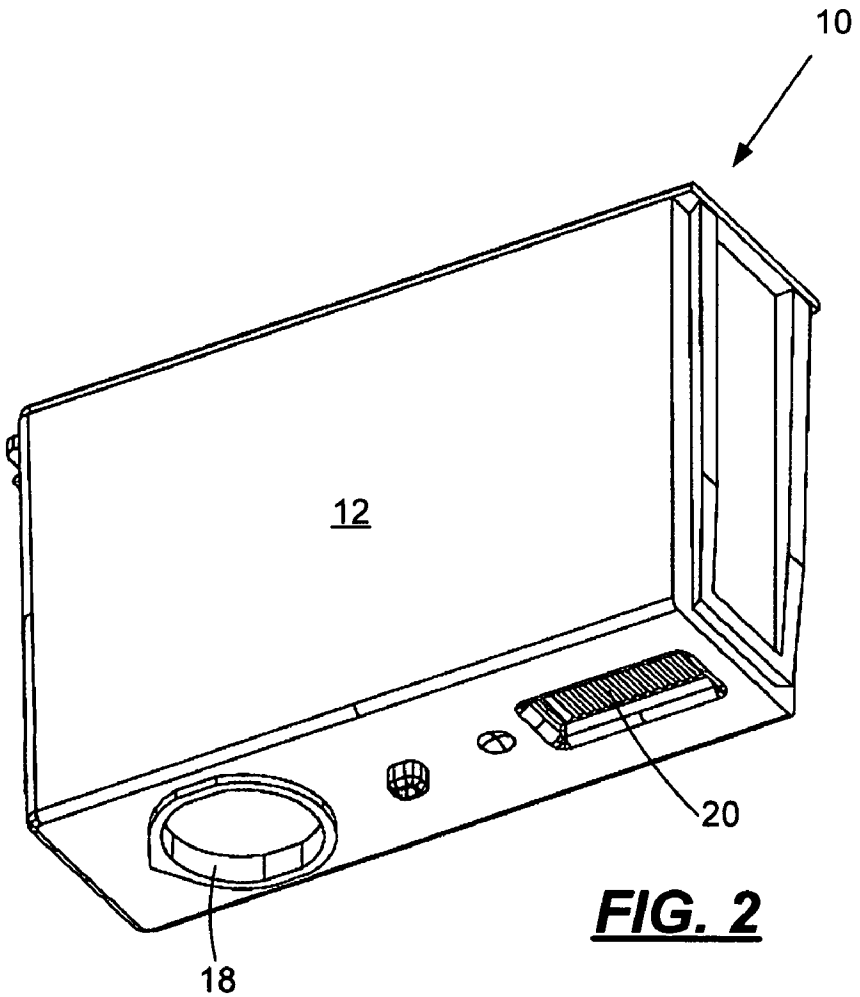
FIG. 2 is a bottom perspective view, not to scale, of a fluid supply cartridge and fluid outlet port therein.

With reference to FIGS. 1 and 2, perspective views of a fluid cartridge 10 are illustrated. The fluid cartridge 10 includes a rigid body 12 and a cover 14 attached to the body 12. The cover 14 may include an inlet port 16 for filling or refilling the body 12 with fluid such as ink.

A bottom perspective view of the fluid cartridge 10 is provided in FIG. 2. A fluid outlet port 18 is provided for flow of fluid out of the fluid cartridge 10 to a micro-fluid ejection head structure described in more detail below. The fluid cartridge 10 may also include a substantially transparent panel 20 for detecting a liquid presence in the fluid cartridge 10.

The rigid body 12 and cover 14 of the fluid cartridge 10 may be made of a variety of materials including, but not limited to, metals, plastics, ceramics, and the like, provided they are made of materials compatible with the fluids they contain. In that regard, a polymeric material that may be used to provide the body 12 and cover 14 may be selected from the group consisting of an amorphous thermoplastic polyetherimide available from G.E. Plastics of Huntersville, N.C., a glass filled thermoplastic polyethylene terephthalate resin available from E. I. du Pont de Nemours and Company of Wilmington, Del., a syndiotactic polystyrene containing glass fiber available from Dow Chemical Company of Midland, Mich., a polyphenylene oxide/high impact polystyrene resin blend available from G.E. Plastics, and a polyamide/polyphenylene ether resin available from G.E. Plastics.

Figure 3:
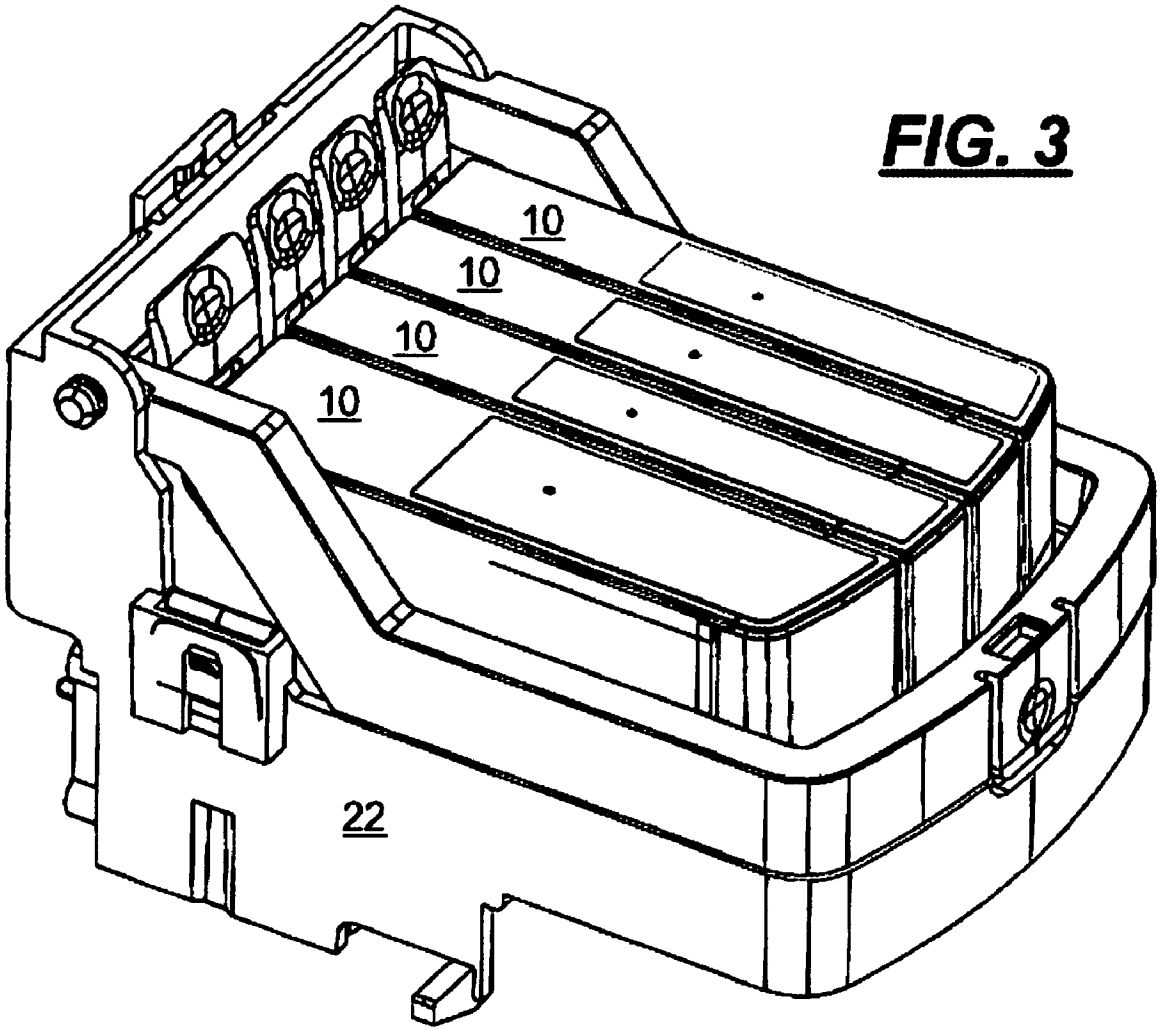
FIG. 3 is perspective view, not to scale, of a multi-cartridge carrier containing multiple cartridges for a micro-fluid ejection device.

When permanent or semi permanent ejection heads are used, the ejection heads may be attached to a multiple fluid cartridge carrier 22 (FIG. 3). The carrier 22, shown in FIG. 3, includes multiple slots for replaceable fluid cartridges 10.

Figure 4:
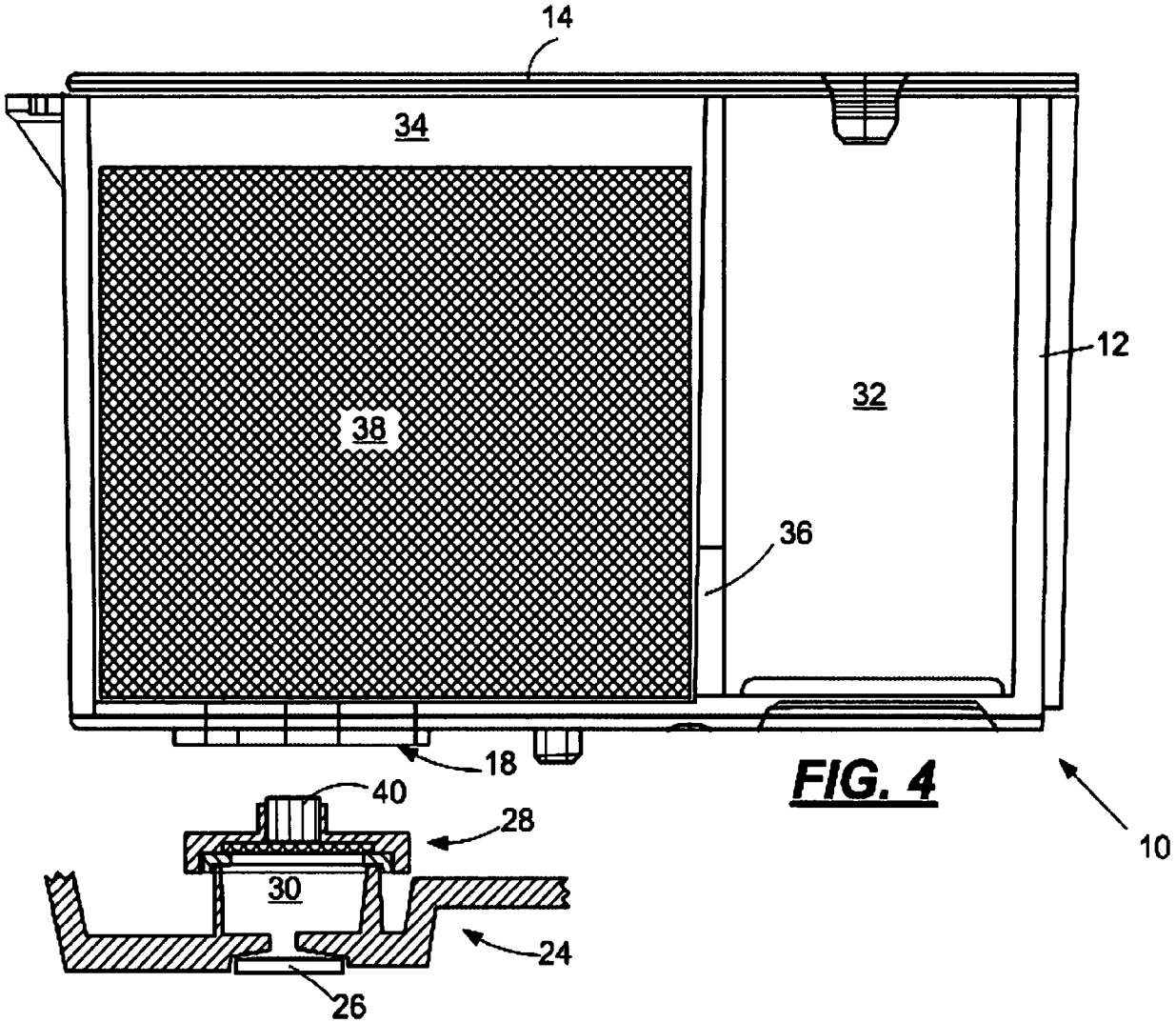
FIG. 4 is a cross-sectional view, not to scale, of a fluid supply cartridge containing a negative pressure inducing device therein and a portion of a micro-fluid ejection head structure for connection to the fluid supply cartridge.

A cross-sectional view of a fluid cartridge 10 and ejection head structure 24 containing an ejection chip 26 is illustrated in FIG. 4. The ejection head structure 24 may be fixedly or removably attached to the carrier 22. The ejection head structure 24 includes a wicking and filtration component 28 that is attached to a filtered fluid reservoir 30 of the ejection head structure 24.

As shown in FIG. 4, the fluid cartridge 10 may have two compartments therein, a liquid compartment 32 and a negative pressure producing material containing cavity 34. A liquid flow path 36 is provided between the liquid compartment 32 and the negative pressure producing material containing cavity 34. The negative pressure producing material containing cavity 34 may contain a negative pressure inducing device 38 such as a felted foam. For the purposes of this disclosure, a wide variety of negative pressure inducing devices 38 may be used provided the device is in intimate contact with a fluid outlet wick 40 when a fluid cartridge 10 is attached to the micro-fluid ejection head structure 24. Such negative pressure inducing devices 38 may include, but are not limited to, open cell foams, felts, capillary containing materials, absorbent materials, and the like.

As used herein, the terms "foam" and "felt" will be understood to refer generally to reticulated or open cell foams having interconnected void spaces, i.e., porosity and permeability, of desired configuration which enable a fluid to be retained within the foam or felt and to flow therethrough at a desired rate for delivery to the micro-fluid ejection chip. 26. Foams and felts of this type are typically polyether-polyurethane materials made by methods well known in the art. A commercially available example of a suitable foam is a felted open cell foam which is a polyurethane material made by the polymerization of a polyol and toluene diisocyanate. The resulting foam is a compressed, reticulated flexible polyester foam made by compressing a foam with both pressure and heat to specified thickness.

Figure 5:
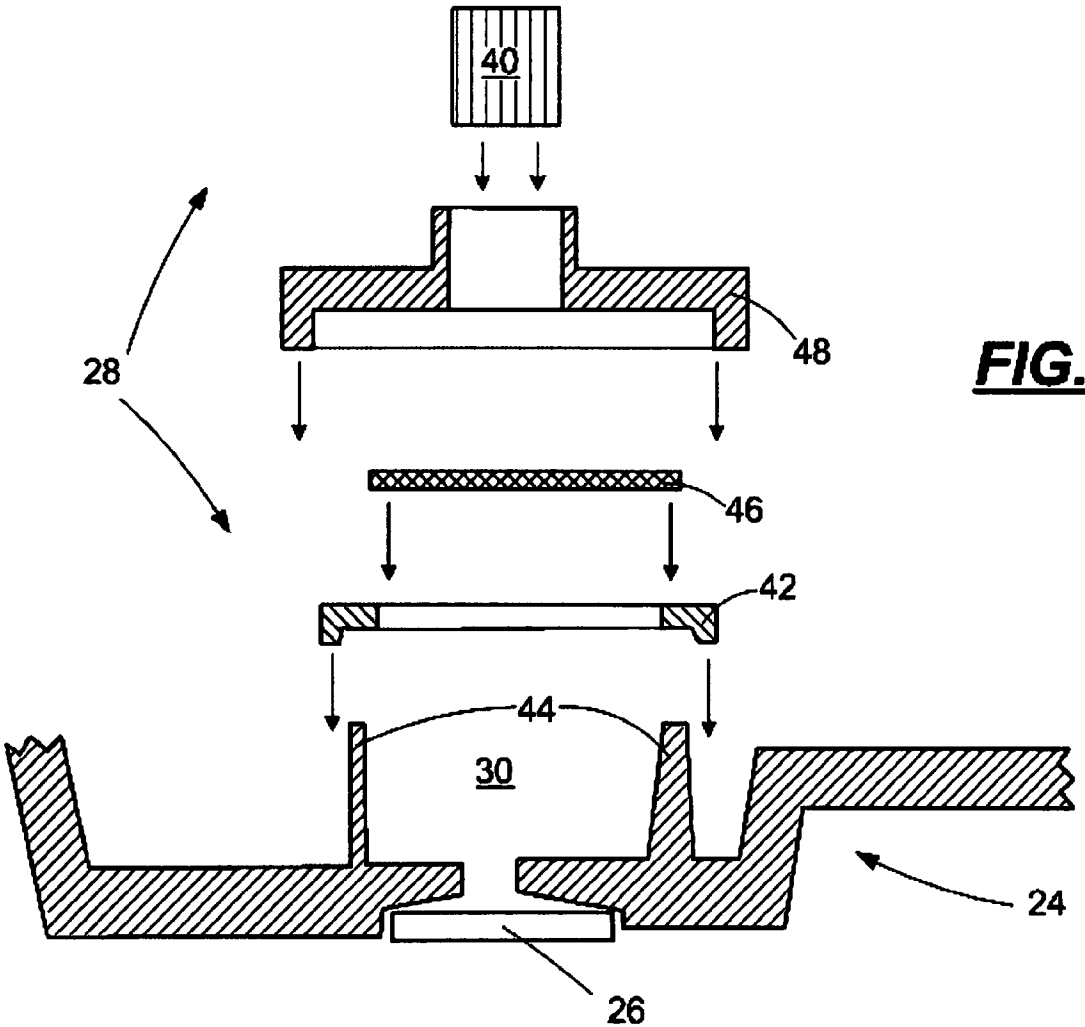
FIG. 5 is a cross-sectional exploded view, not to scale, of a portion of a micro-fluid ejection head structure.

With reference to FIG. 5, an exploded view, not to scale of a wicking and filtration component 28 is illustrated. The wicking and filtration component includes a filter cap 42 that is fixedly attached to side walls 44 of the filtered fluid reservoir as by adhesive, laser welding, ultrasonic welding, heat staking, and the like. A filter 46 may of plastic mesh or wire mesh 46 is attached to the filter cap 42 as by heat staking or laser welding. Next a wick retainer 48 is pressed onto the filter cap 42 and the wick 40 is press-fitted into the wick retainer 48 to provide the wicking and filtration component 28.

Each of the items 40, 42, 46, and 48 of the wicking and filtration component 28 has a manufacturing tolerance. Accordingly, the sum of the manufacturing tolerances of each of the items 40, 42, 46, and 48 provides the overall manufacturing tolerance of the wicking and filtration component 28.

One of ordinary skill will readily recognize that the invention is not limited to the illustrated embodiment. For example, in an alternative embodiment, a plurality of filtered fluid reservoirs may be covered with a single cap, and four or more wicking and filtration structures may be disposed in said cap.

As illustrated in FIGS. 3 and 4, when the cartridge 10 is disposed in the carrier 22, the wicking and filtration component 28 is disposed through the fluid outlet port 18 so that the wick 40 is in intimate fluid flow contact with the negative pressure inducing device 38 in cavity 34 of the cartridge 10. As fluid is ejected by the ejection chip 26, fluid is caused to refill the fluid reservoir 30 by flow from the negative pressure inducing device 38, through the wick 40 and the filter 46. A conventional wick 40 is thus composed of capillary paths between, for example, polyolefin felted fibers such as polyethylene or polypropylene fibers.

Figure 6:
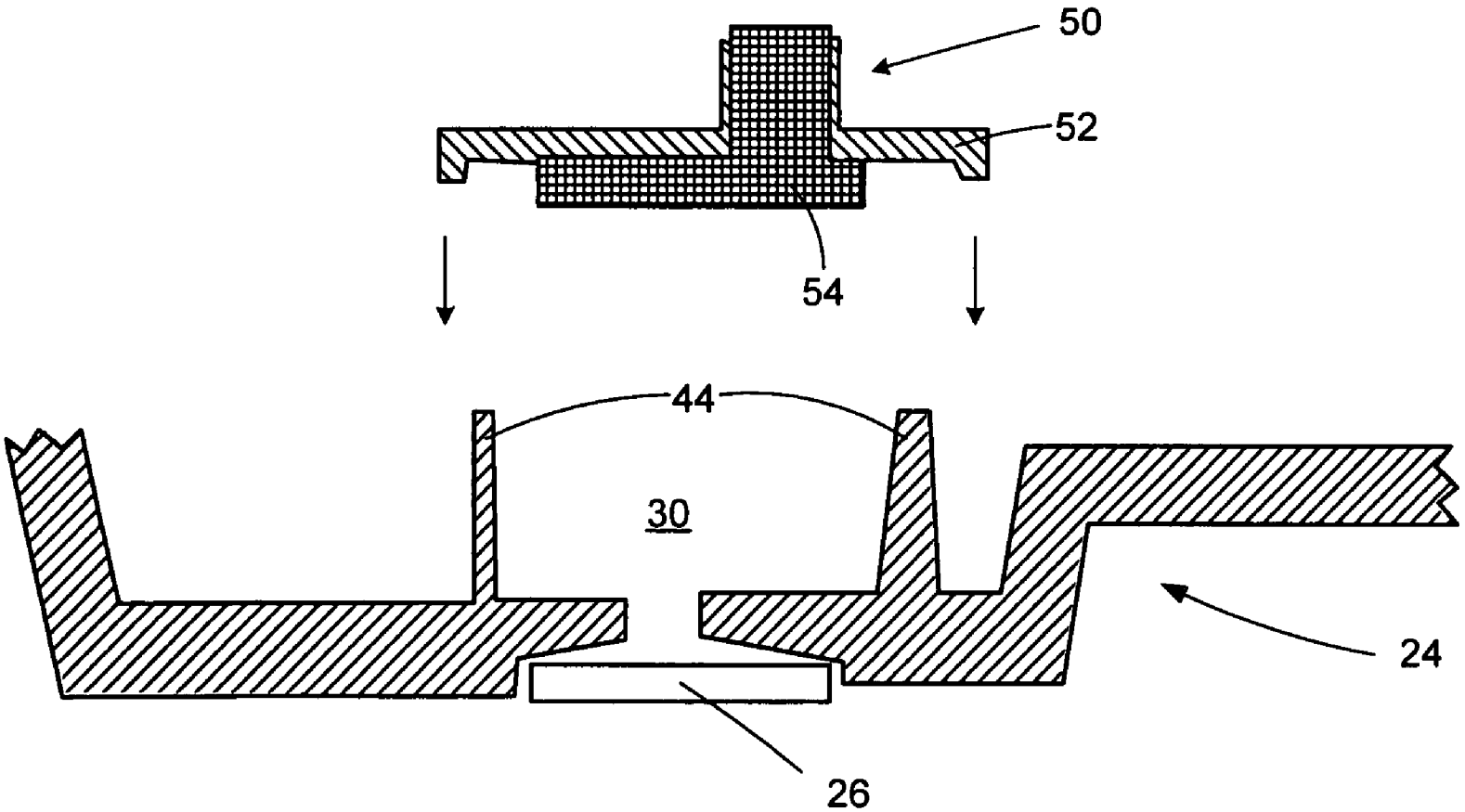
FIG. 6 is a cross-sectional exploded view, not to scale, of a portion of a micro-fluid ejection head structure according to an embodiment of the disclosure.
Figure 7:
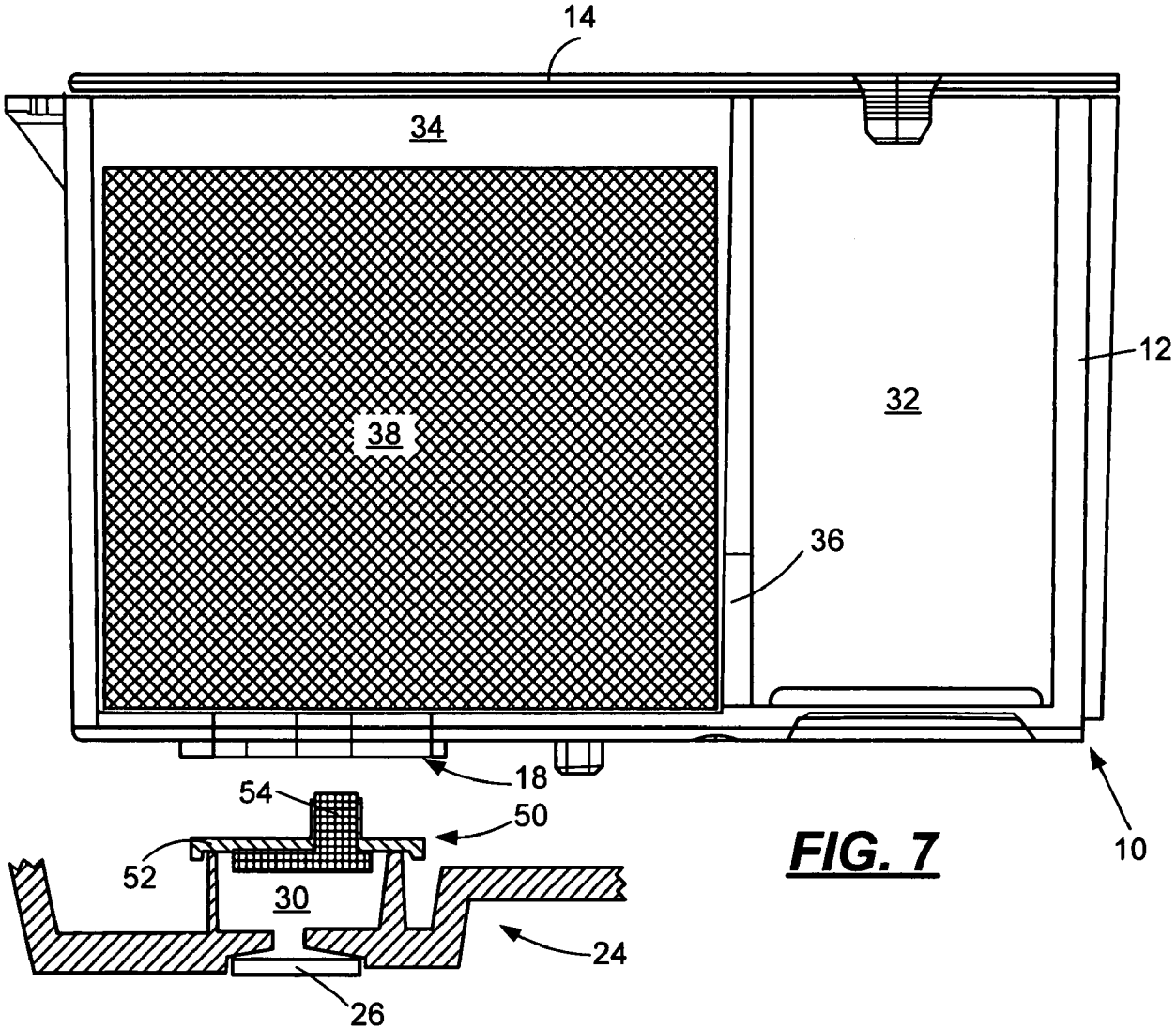
FIG. 7 is a cross-sectional view, not to scale, of a fluid supply cartridge containing a negative pressure inducing device therein and a portion of a micro-fluid ejection head structure according to the disclosure for connection to the fluid supply cartridge.

With reference to FIGS. 6 and 7, an improved wicking and filtration device 50 is illustrated. The device 50 includes a filter cap 52 and an integrally molded, non-fibrous wicking and filtration component 54 providing a substantially unitary wicking and filtration device 50. The molded, non-fibrous wicking and filtration component 54 may be provided by a hydrophilic, polymeric porous substrate made of a polyolefin or polyester material. Such polymeric material may include sintered thermoplastic particles providing a nominal pore size therein ranging from about 5 to about 50 microns.

In an alternative embodiment, the wicking and filtration component 54 of device 50 may include a plurality of porosity zones therein, for example, a wicking zone and a filtration zone each having a different nominal pore size. Such wicking and filtration components are available from Porex Corporation of Fairburn, Ga. and may be made according to one or more of U.S. Pat. Nos. 5,432,100 and 6,030,558 to Smith, et al.

Attachment of the wicking and filtration device 50 to the side walls 40 of the filtered fluid reservoir 30 may be achieved by a variety of techniques including, but not limited to, laser welding, heat staking, ultrasonic welding, adhesives, and the like. Since an essentially unitary device 50 is provided, only a single step is required to attach the filtration and wicking device 50 to the micro-fluid ejection head structure 24. In contrast, in prior wicking and filtration devices, at least four assembly steps were required to attach the wicking and filtration device to the micro-fluid ejection head structure 28.

Furthermore, since the components 52 and 54 of the wicking and filtration device 50 are integrally molded to provide the essentially unitary device 50, only a single manufacturing tolerance for the overall device 50 is required. Thus the manufacturing tolerances for the wicking and filtration device 50 may be substantially less than the combined manufacturing tolerances for existing wicking and filtration components.

With reference now to FIGS. 3 and 7, when the cartridge 10 is disposed in the carrier 22, the wicking and filtration device 50 is disposed through the fluid outlet port 18 so that the wicking and filtration component 54 is in intimate fluid flow contact with the negative pressure inducing device 38 in cavity 34 of the cartridge 10. As fluid is ejected by the ejection chip 26, fluid is caused to refill the fluid reservoir 30 by flow from the negative pressure inducing device 38, through the wicking and filtration component 54.

Having described various aspects and embodiments of the disclosure and several advantages thereof, it will be recognized by those of ordinary skills that the embodiments are susceptible to various modifications, substitutions and revisions within the spirit and scope of the appended claims.

What is claimed is:

1. A micro-fluid ejection head structure comprising a molded, non-fibrous wicking and filtration structure fixedly attached to a filtered fluid reservoir of the micro-fluid ejection head structure for flow of filtered fluid to a micro-fluid ejection chip attached to the head structure, wherein the wicking and filtration structure comprises a hydrophilic, polymeric porous substrate and a filter cap molded to the porous substrate to provide a unitary cap, wicking and filtration structure.

2. The micro-fluid ejection head structure of claim 1, wherein the hydrophilic, polymeric porous substrate includes one or more different porosity zones therein.

3. The micro-fluid ejection head structure of claim 1, wherein the wicking and filtration structure comprises a polyester, polypropylene, polyethylene, or PET material.

4. The micro-fluid ejection head structure of claim 1, wherein the wicking and filtration structure is fixedly attached to the filtered fluid reservoir by a method selected from the group consisting of laser welding, ultrasonic welding, and heat staking.

5. The micro-fluid ejection head structure of claim 1, wherein the wicking and filtration structure is adhesively attached to the filtered fluid reservoir.

6. The micro-fluid ejection head structure of claim 1, wherein the wicking and filtration structure comprises sintered thermoplastic particles providing a nominal pore size ranging from about 5 to about 50 microns.

7. A method for assembling a micro-fluid ejection head structure for a fluid supply cartridge, the method comprising the steps of providing a molded, non-fibrous wicking and filtration structure; and fixedly attaching the wicking and filtration structure to a filtered fluid reservoir of the micro-fluid ejection head structure for flow of filtered fluid from a supply cartridge to a micro-fluid ejection chip attached to the head structure, wherein the wicking and filtration structure comprises a hydrophilic, polymeric porous substrate and a filter cap molded to the porous substrate to provide an integrated cap, wicking and filtration structure.

8. The method of claim 7, wherein the filter cap is fixedly attached to the filtered fluid reservoir by a method selected from the group consisting of laser welding, ultrasonic welding, and heat staking.

9. The method of claim 7, wherein the filter cap is fixedly attached to the filtered fluid reservoir by use of an adhesive.

10. The method of claim 7, wherein the hydrophilic, polymeric porous substrate includes one or more different porosity zones therein.

11. The method of claim 7, wherein the wicking and filtration structure comprises a polyester, polypropylene, polyethylene, or PET material.

12. The method of claim 7, wherein the wicking and filtration structure comprises sintered thermoplastic particles providing a nominal pore size ranging from about 5 to about 50 microns.

13. A fluid supply reservoir carrier comprising a micro-fluid ejection head structure made by the method of claim 7.

14. A fluid supply cartridge for a micro-fluid ejection head comprising a micro-fluid ejection head structure made by the method of claim 8.

15. A fluid supply cartridge carrier comprising a permanent or semi-permanent micro-fluid ejection head structure, the ejection head structure comprising a micro-fluid ejection chip, a filtered fluid reservoir in fluid flow communication with the micro-fluid ejection chip, and a wicking and filtration structure fixedly attached to the filtered fluid reservoir for flow of filtered fluid to the filtered fluid reservoir, wherein the wicking and filtration structure comprises a molded, non-fibrous wicking and filtration element, wherein the wicking and filtration structure comprises a hydrophilic, polymeric porous wicking and filtration member and a filter cap molded to the wicking and filtration member to provide a unitary cap, wicking and filtration structure.

16. The fluid supply cartridge carrier of claim 15, wherein the hydrophilic, polymeric porous wicking and filtration member has at least two different porosity zones therein.

17. The fluid supply cartridge carrier of claim 15, wherein the wicking and filtration structure is fixedly attached to the filtered fluid reservoir by a method selected from the group consisting of laser welding, ultrasonic welding, and heat staking.

18. A micro-fluid ejection head structure comprising a molded, non-fibrous wicking and filtration structure fixedly attached to a filtered fluid reservoir of the micro-fluid ejection head structure for flow of filtered fluid to a micro-fluid ejection chip attached to the head structure, wherein the wicking and filtration structure comprises a hydrophilic, polymeric porous substrate having one or more different porosity zones therein.

19. A micro-fluid ejection head structure comprising a molded, non-fibrous wicking and filtration structure fixedly attached to a filtered fluid reservoir of the micro-fluid ejection head structure for flow of filtered fluid to a micro-fluid ejection chip attached to the head structure, wherein the wicking and filtration structure comprises sintered thermoplastic particles providing a nominal pore size ranging from about 5 to about 50 microns.

* * * * *